United States Patent [19]

Williams

[11] Patent Number: 4,594,994

[45] Date of Patent: Jun. 17, 1986

[54] CROSS-BOWS

[75] Inventor: Ivan P. Williams, Huntingdon, England

[73] Assignee: Oakland Design Products Limited, Leamington Spa, England

[21] Appl. No.: 584,621

[22] Filed: Feb. 29, 1984

[30] Foreign Application Priority Data

Mar. 4, 1983 [GB] United Kingdom ..... 8306072

[51] Int. Cl.[4] ..... F41B 5/00

[52] U.S. Cl. ..... 124/25

[58] Field of Search ..... 38124/22, 25, 35 A

[56] References Cited

U.S. PATENT DOCUMENTS 3,670,711 6/1972 Firestone ..... 124/25

3,857,379 12/1974 Burghardt ..... 124/22

3,968,783 7/1976 Pfotenhauer ..... 124/25

*Primary Examiner*—Richard C. Pinkham

*Assistant Examiner*—Benjamin Layno

*Attorney, Agent, or Firm*—Charles R. Rhodes; Judith E. Garmon

[57] ABSTRACT

A cross-bow (10) having a tiller (12) which comprises a forward portion (14) and a stock (16), a prod (20) carrying the bowstring (30) mounted on the forward portion a bowstring arrestor and release mechanism (78) and a cocking mechanism (M) of which the prod or the arrestor and release mechanism is a slider mounted for reciprocal movement along the stock to facilitate cocking the bow.

7 Claims, 11 Drawing Figures

CROSS-BOWS

This invention relates to a cross-bow.

A traditional cross-bow comprises a short bow or prod which is mounted on a tiller and which, in use, is levelled against the shoulder like its successor the musket.

In order to cock the traditional bow the bowstring is drawn back by hand or by means of some mechanical aid which can range from a simple lever to a windlass or the rack and pinion mechanism (cranequin).

One of the disadvantages in the use of a cross-bow lies in the time taken to span and discharge the bow. Known mechanisms are operable so as to draw back the bowstring away from the prod which remains fixed relative to the tiller, until the bowstring is arrested ready to receive a bolt.

This well known method also has the disadvantage that in drawing back the bowstring some measure of torque is applied to it so that when the bow is discharged torsion in the bowstring suddenly is relieved which can disturb the smooth discharge of the bolt.

The present invention seeks to overcome these disadvantages and to give a rapid loading, smooth firing bow.

One aspect of the invention provides a cross-bow having a tiller and a prod which is mounted for reciprocal movement relative to the tiller to facilitate cocking the bow.

Another aspect of the invention provides a cross-bow having a tiller which includes a stock and a butt mounted for rotation relative to the stock so that the bow can be levelled with the prod in a horizontal or a vertical attitude.

Yet another aspect of the invention provides a cross-bow having a tiller on which a prod is mounted for selective positioning so that the draw length of the bow can be adjusted by altering the position of the prod.

A further aspect of the invention provides in or for a cross-bow a cocking mechanism comprising a slider block adapted to receive the limbs of the prod, a connecting lever having one of its ends pivotally mounted to said slider block and a crank lever having one of its ends pivotally mounted intermediate the ends of said connecting lever and an opposite end pivotally connected or connectable to the tiller of said bow.

Figure 1:
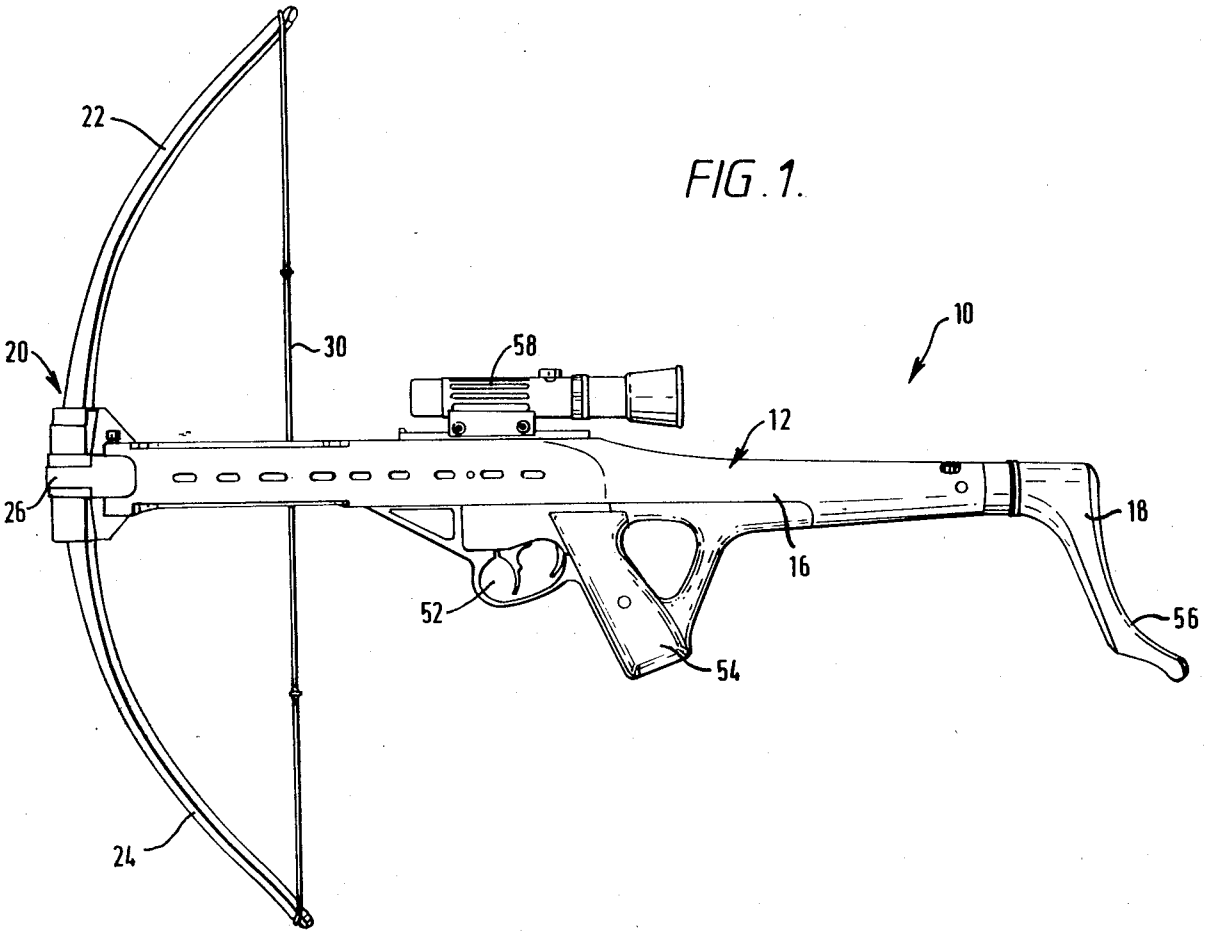
Figure 7:
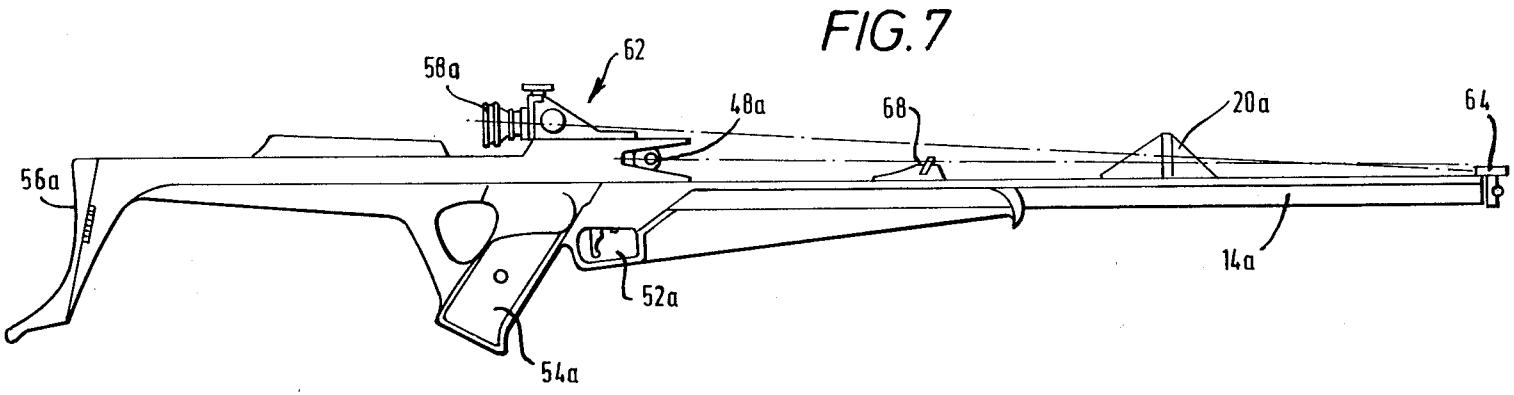
Figure 7A:
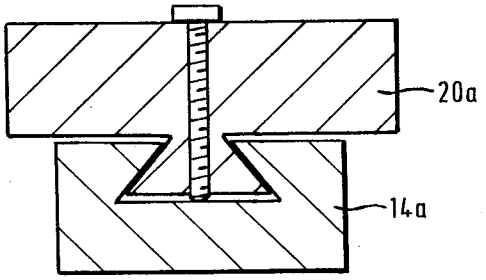
Figure 8:
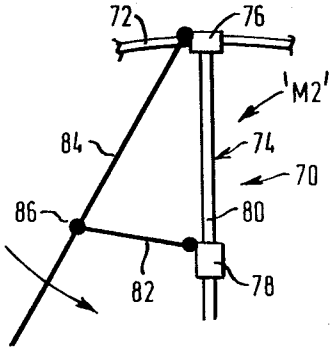
Figure 1A:
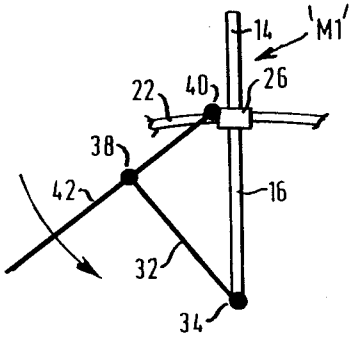
Figure 2:
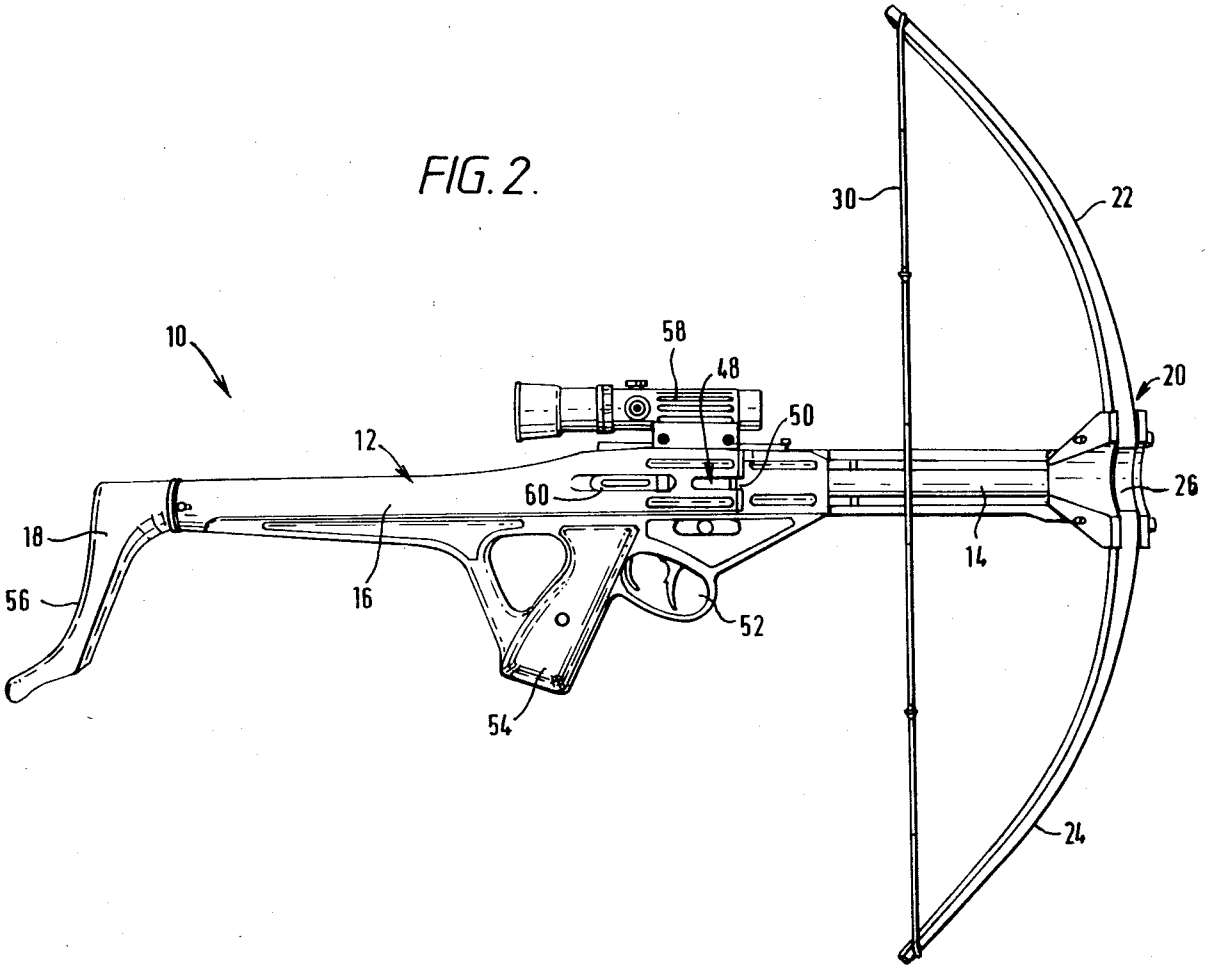
Figure 3:
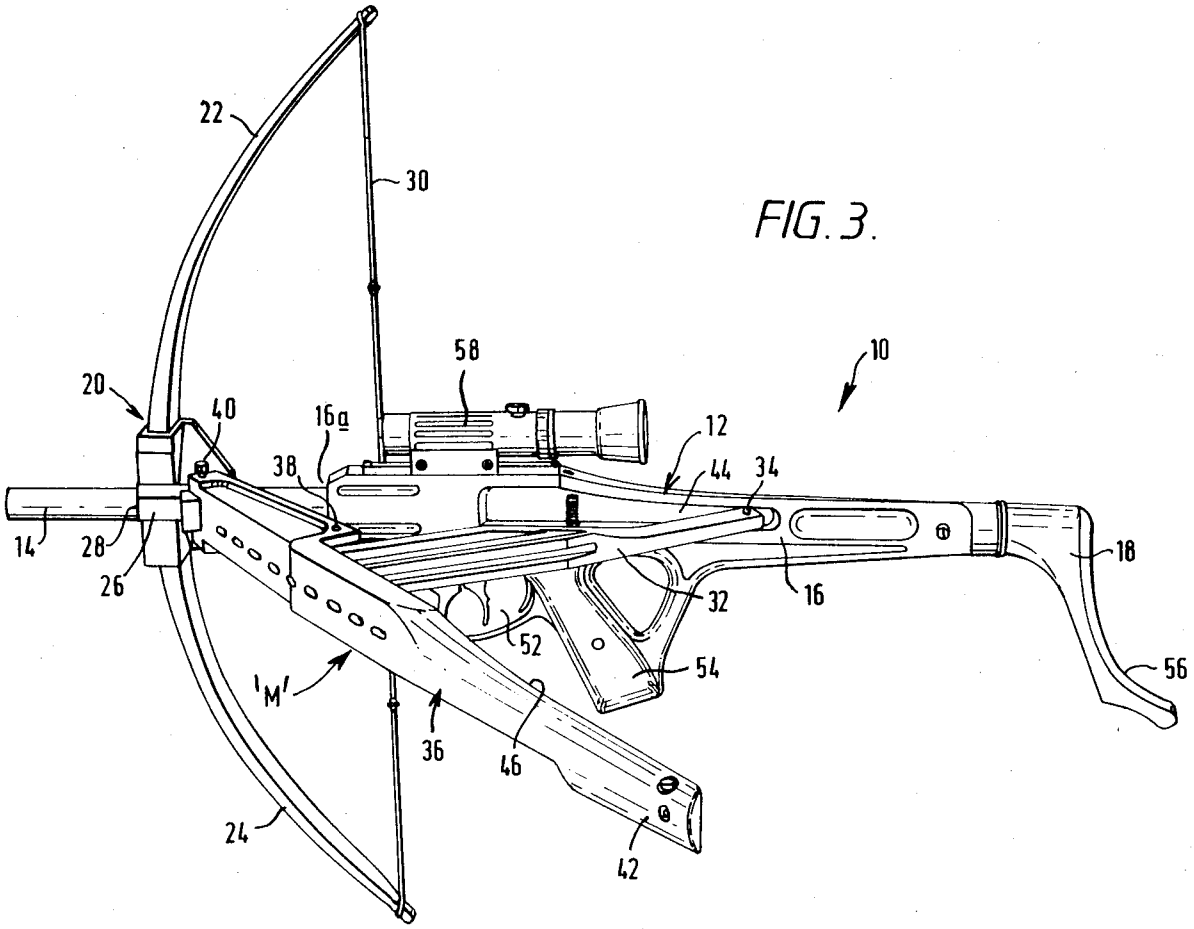
Figure 3A:
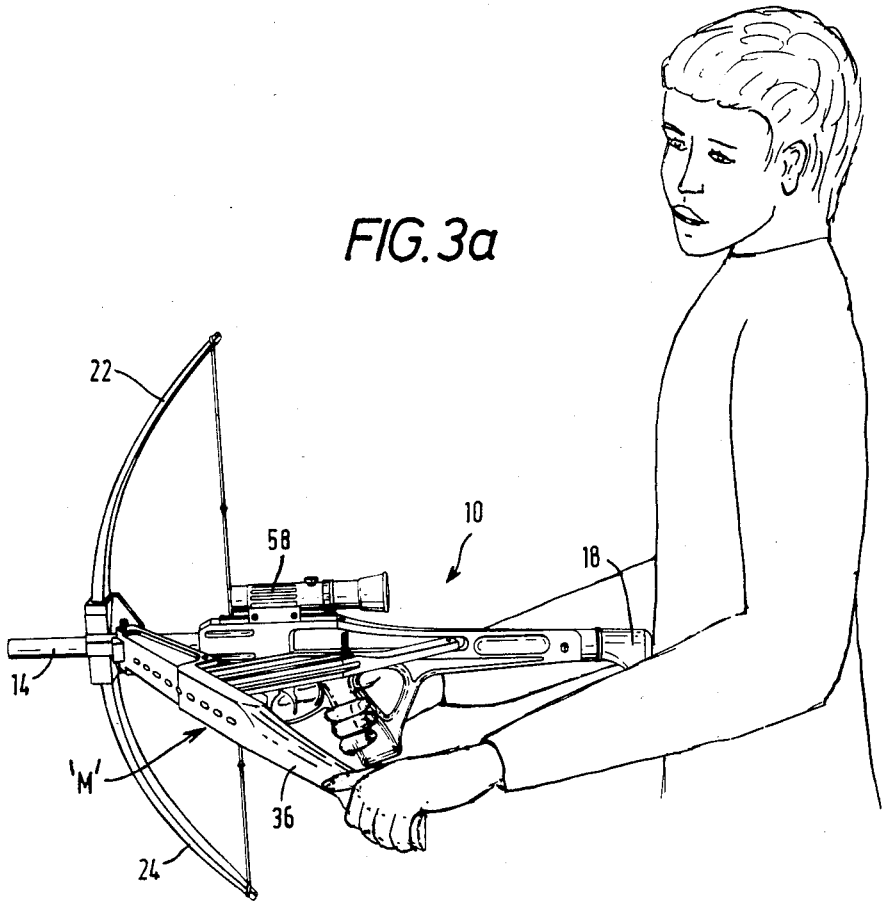
Figure 4:
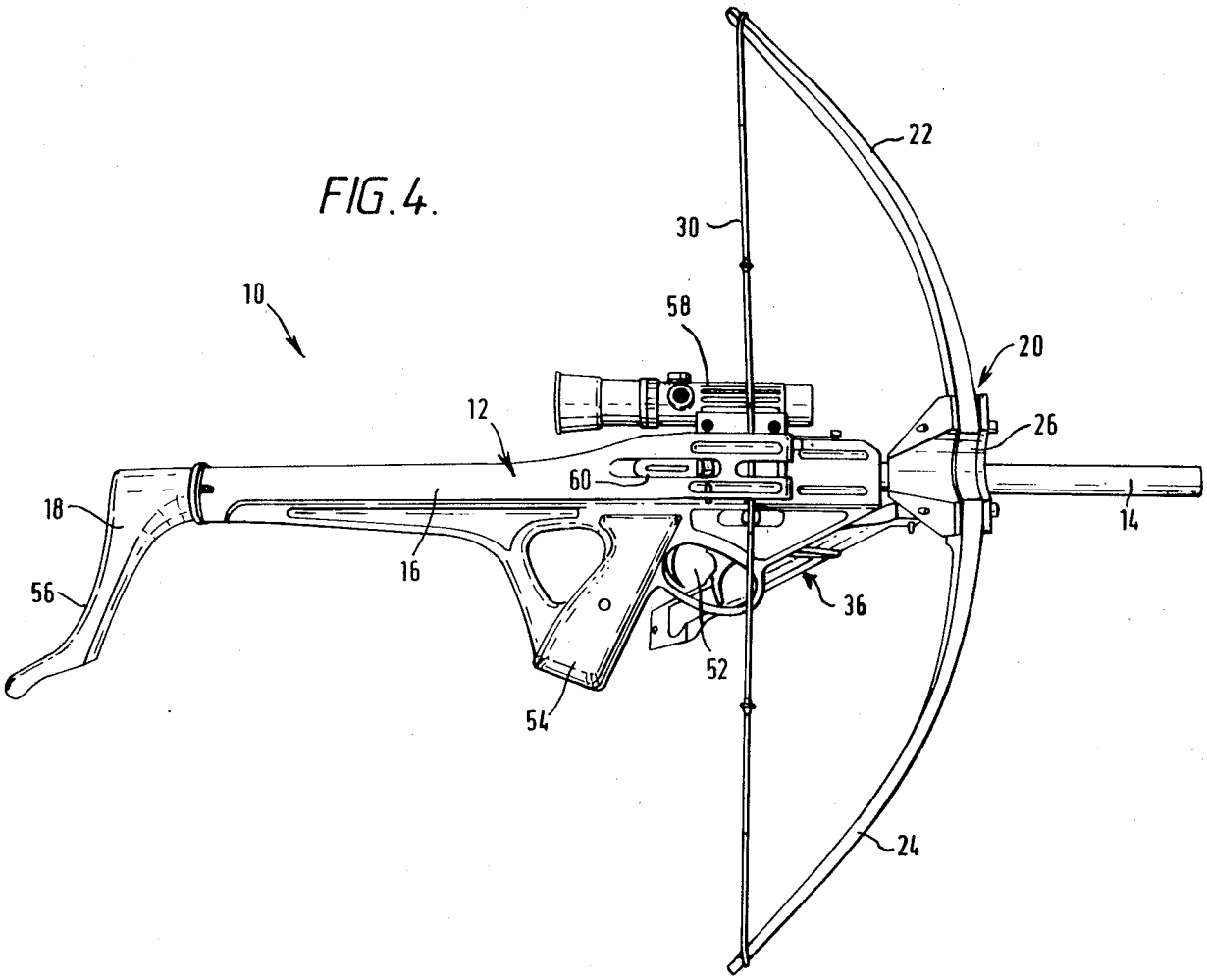
Figure 5:
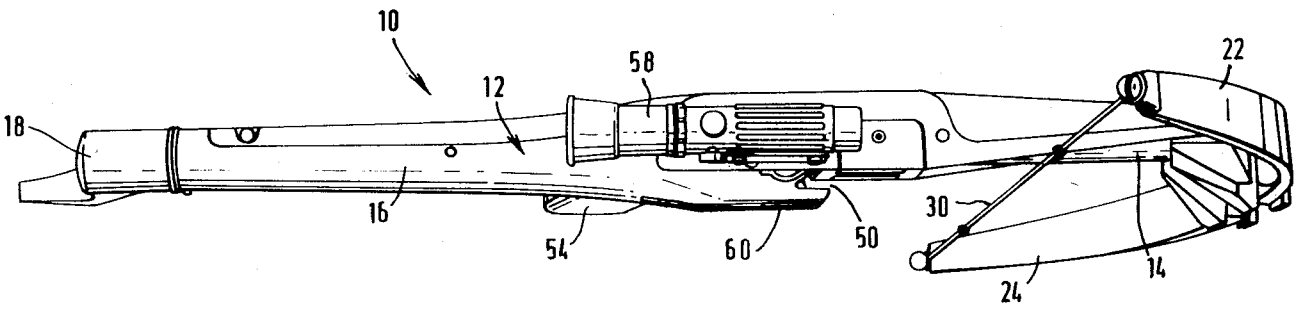
Figure 6:
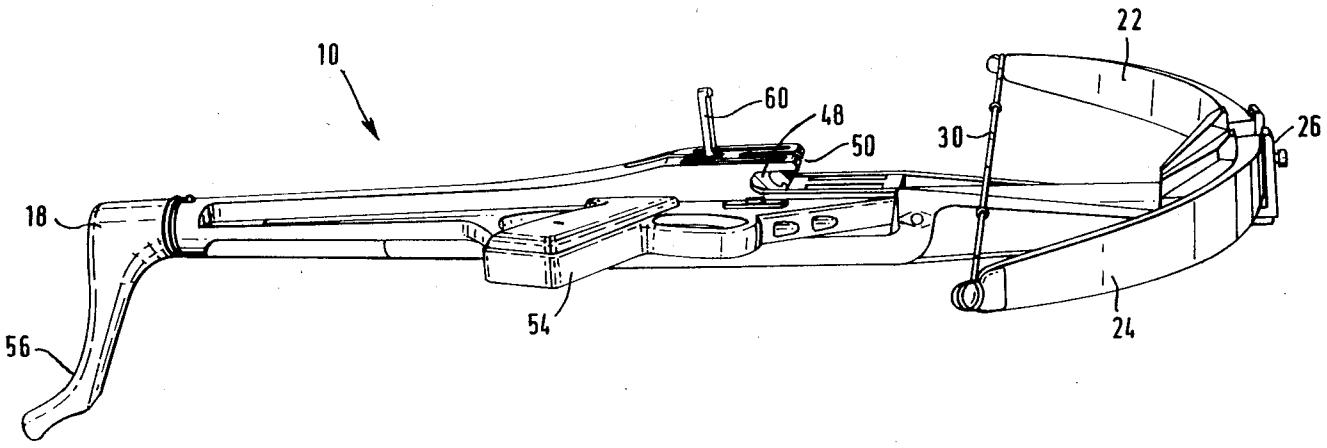

Cross-bows embodying the invention will now be described, by way of example, with reference to the accompanying drawings, in which:

FIG. 1 is a perspective view of a cross-bow taken from one side in which the prod is unstrained and vertical, FIG. 1*a* is a schematic view of the cocking mechanism, FIG. 2 is a perspective view of the same bow as seen from the opposite side, FIG. 3 is a perspective view of the bow of FIG. 1 showing the cocking mechanism opened during the cocking action, FIG. 3*a* is a similar view to that of FIG. 3 but showing the bow held and the connecting lever being manipulated during cocking, FIG. 4 is a perspective view of the bow showing the prod at the innermost (rearward) end of its travel with the bowstring arrested, FIG. 5 is a perspective view of the bow as seen from above and similar to that of FIG. 1 but with the bow turned through 90°, FIG. 6 is a perspective view of the bow similar to that of FIG. 1 with the heel butt turned through 90° so that the bow can be levelled for firing with the prod horizontal, FIG. 7 is a side view of a different cross-bow according to another aspect of the invention, FIG. 7*a* is a cross-section through the stock of the bow shown in FIG. 7, FIG. 8 is a schematic view of a cocking mechanism of a cross-bow according to yet another aspect of the invention.

Referring first to FIGS. 1–6 of the drawings, there is shown a cross-bow 10 suitable for use as a hunting bow, which comprises a tiller 12 having a forward portion 14, a body or stock 16 and a heel butt 18. A prod 20 mounted on the forward portion has an upper limb 22 and a lower limb 24 both joined to, and a carried by, a draw block 26. The draw block is mounted on the forend 14 for reciprocal movement towards and away from the stock 16 in order to charge the bow. In this embodiment of the invention, the forward portion 14 comprises a hollow tube of circular cross-section and the draw block 26 is formed with a central bore 28 in which the forend tube 14 is a sliding fit. Other forward portion constructions are envisaged and it will be apparent that the forward portion may have a cross-section other than circular. The free ends of the limbs 22, 24 are interconnected by a stout cord which provides the bowstring 30 of the bow.

In order to load and discharge the bow a cocking mechanism known as a draw mechanism, 'M' (see FIG. 3) is provided which is analogous to a simple slider-crank mechanism. The draw mechanism 'M' comprises a crank lever 32 which has one of its ends pivotally mounted to the stock 16 intermediate the forward portion 14 and heel butt 18 by means of a stock pin 34 and has its opposite end pivotally connected intermediate the ends of a connecting lever 36 by means of a crank pin 38. The 'slider' of the draw mechanism comprises the draw block 26 to which one end of the connecting lever 36 pivotally is mounted by means of block pin 40.

The connecting lever extends beyond the pivotal connection at the crank pin 38 to provide a grip portion 42 by which the draw mechanism is manipulated. The crank pin 38 provides the fulcrum for the grip portion.

The cross-bow in uncocked position is best shown in FIGS. 1 and 2. Here the draw block 26 is disposed adjacent the free end of the forward portion tube 14 and the draw mechanism 'M' is in its stable condition. That is to say, the pivot pins 34, 38 and 40 are substantially aligned along (but normal of) the main longitudinal axis of the tiller. Hence, the crank lever 32 and the connecting lever 36 are superposed one on the other so that the connecting lever lies parallel to the stock 12. In this construction, the stock and the connecting lever 36 each is formed with an elongate recess 44 and 46 respectively which recesses together provide a cavity in which the crank lever 32 is accommodated when the draw mechanism is in its stable condition. Indeed, the grip portion 42 extending between crank pin 38 and the free end of lever 36 is shaped so as to fit flush against, and form a part of, the stock when the draw mechanism is in its stable condition.

To cock the bow, the grip portion 42 of the connecting lever 36 is manipulated so that it is pushed away from the stock to pivot about block pin 40 (see FIGS. 3 and 3*a*). This action necessarily causes the draw block to slide along the forward portion tube 14 towards the adjacent shoulder 16*a* of the stock. Thus, the prod 20 and bowstring 30 are moved rearwardly together as a unit. A bowstring arrestor and release mechanism shown generally at 48 (see FIG. 2) is provided on the stock and is positioned automatically to arrest the bowstring when it enters the mouth 50 of the mechanism. This occurs when the draw block 26 comes to the end of its travel along the forward portion tube 14 and is located at the fixed end of the tube adjacent the stock shoulder 16*a*. The bowstring arrestor and release mechanism 48 is of known construction per se and is operatively connected to a double-set trigger 52. This arrangement is not therefore specifically described.

Once the bowstring is arrested, the connecting lever 36 is pushed back into flanking relationship with respect to the stock so that the draw mechanism is again put into its stable condition. In so doing, the draw block 26 is constrained to slide along the forward portion tube 14 to adopt the initial position shown in FIGS. 1 and 2. Of course, this return motion puts both the prod 20 and bowstring 30 into 'firing' tension whereby the bow is cocked ready to receive a bolt (not shown). The bow is charged by introducing the nock of a bolt into the mouth 50 of the arrestor and discharge mechanism 48 so that it is engaged by the bowstring. Suitable support and guide means which, for example could comprise an apertured plate giving the bolt three-point support adjacent its tip may be carried by the draw block. Thus, the bolt is held only at its nock and discharged from the bow by squeezing the trigger whereby the bowstring arrestor and discharge mechanism releases the bowstring.

In order to level the bow for discharge, a trigger grip 54 extends downwardly from the underside of the stock and is generally constructed to be held in a similar fashion to that of a rifle. Further the heel butt of the bow is formed to provide a shoulder rest 56 which is rotatable about the longitudinal axis of the stock. This feature allows the bow to be held for discharge in either one of two attitudes.

First, the bow may be held by its stock 16 and trigger grip 54 with the prod 20, trigger grip 54 and shoulder rest 56 all extending downwardly in a plane passing vertically through the tiller 12. Thus, a bolt is discharged from a position in which it is supported alongside the stock opposite to that at which the draw mechanism is carried. In this attitude the bow may be aimed by using the (telescopic) sight 58 provided on the upper face of the stock. A foresight may be provided by the draw block or by the forward portion tube if desired.

Secondly, the bow may be held by its stock and trigger grip with the prod and trigger extending outwardly in a notional plane passing horizontally through the tiller and with the shoulder rest 56 swivelled through 90° in relation to the prod and trigger grip so that it remains in a downwardly extending position. Thus, the bolt is supported uppermost of the stock and the bow is therefore levelled in a manner similar to that of a conventional cross-bow construction. This is illustrated in FIG. 6.

In order to aim the bow when it is held in this attitude an additional aiming sight 60 is provided on the stock. Sight 60 pivotally is mounted to that part of the stock which incorporates the bowstring arrestor and discharge mechanism 48. The sight 60 may be raised into the position shown in FIG. 6 from a stowed position in which it lies flush with the stock.

It will be appreciated that the draw distance of the prod may be varied in order to alter the potential thrust of the bow.

In the draw mechanism described, the ratio of the distance between the block pin to the crank pin and the crank pin to the free end of the connecting lever is approximately 1:2 as measured along the connecting lever. It is to be understood that other ratios may be chosen and indeed the construction may be such as to facilitate such a change. In this regard, the forward portion tube and/or crank lever may be readily removed and replaced by similar components of different lengths and the position of the crank pin along the connecting lever also may be selectively adjustable.

Preferably, the block pin 40 is readily removable or releasable to allow the prod 20 to be removed by sliding the draw block 26 forwardly off the forward position tube 14, to facilitate carrying of the cross-bow. For example, the block pin 40 may be provided by an Allen bolt which is easily removed when required. In another possible arrangement this pivot may be provided by upper and lower spring-loaded pins or buttons which can be depressed to provide a quick-release of the prod. This removable or releasable facility of the prod also allows different prods, all having the same draw length, to be used interchangeably on the cross-bow.

Referring now to FIG. 7 of the drawings, there is shown another cross-bow 62 suitable for use as a target bow. This bow may have a draw mechanism similar to that described previously or may have another (or no) mechanical aid to facilitate cocking the bow. In relation to the bow 10, like parts are designated with like reference numerals with the addition of suffix 'a'.

In this construction the forend 14*a* of the bow is considerably more elongate and carries a front sight 64. The prod 20*a* is mounted for selective positioning along the forward portion so that the draw length of the bow can be adjusted by altering the position of the prod. To this end, the forward portion may have a dovetail groove into which the prod slidingly is received by means of a cooperating key as shown in FIG. 7*a*. Other key and groove arrangements are envisaged.

An additional arrow rest 68 which also can be adjustably mounted on the forward portion is provided to give support for various length arrows.

FIG. 8 shows schematically a draw mechanism 'M2' of a cross-bow 70 in which the prod 72 remains stationery relative to the tiller 74 at the forward portion of the bow. In this construction, in contrast to the mechanism of cross-bow 10, the draw block 76 is fixed to the forward portion of the bow and the bowstring arrestor and release mechanism 78 reciprocates along the stock 80 in order to cock the bow. To this end, draw mechanism 'M2' comprises a connecting lever 82 which has one of its ends pivotally mounted to the arrestor and release mechanism 78 slidably mounted on the stock 80 and has its opposite end pivotally connected intermediate the ends of a crank lever 84 by means of crank pin 86. One end of the crank lever 84 is pivotally connected to the fixed draw block 76. The mechanism 'M2' is manipulated in a manner similar to that of mechanism 'M2' but with the effect that the bowstring arrestor and release mechanism slides forwardly to arrest the bowstring and rearwardly to charge the bow. The arrestor and release mechanism may be mounted by means of a mating key and groove assembly similar to the prod mounting described with reference to FIG. 7*a*.

It is to be understood that the term 'prod' as used in this specification is not limited to the flexible limb construction described and shown but may embrace other constructions by which a cross-bow can be charged for firing. For example, it is known to utilize pneumatic rams for this purpose.

I claim:

1. A cross-bow having a tiller including a forward portion and a stock, a prod mounted for reciprocal movement along said forward portion to facilitate cocking the bow and a cocking mechanism connected for operation as a slider-crank mechanism and comprising a connecting lever pivotally mounted to the prod and a crank lever pivotally mounted to the stock and to said connecting lever, and wherein, the pivotal connection between said crank lever and said connecting lever is located intermediate the ends of said connecting lever whereby that portion of the connecting lever which extends between its pivotal connection to the crank lever and its free end provides a grip portion which can be manipulated to operate the cocking mechanism.

2. A cross-bow according to claim 1 wherein said connecting lever is adapted to adopt a stowed position parallel to the longitudinal axis of the tiller.

3. A cross-bow according to claim 1 wherein said connecting lever provides a part of the tiller stock when located in its stowed position.

4. A cross-bow according to claim 1, wherein the stock and the connecting lever are each formed with an elongate recess which together form a cavity in which the crank lever is accommodated when said connecting lever is stowed.

5. A cross-bow according to claim 1 wherein said forward portion comprises a rod on which a slider block which carries the limbs of the prod is mounted for reciprocal movement therealong, said slider block including the pivotal connection between the prod and the connecting lever.

6. A cross-bow according to claim 1, in which the tiller includes a butt mounted for rotation relative to the stock so that the bow can be levelled with the prod in a horizontal or a vertical attitude.

7. A cross-bow according to claim 1 wherein the stock includes an aiming sight for use when the bow is levelled with the prod horizontal and a further aiming sight for use when the bow is levelled with the prod vertical.

* * * * *